US009104144B2

(12) United States Patent
Okabayashi et al.

(10) Patent No.: US 9,104,144 B2
(45) Date of Patent: Aug. 11, 2015

(54) IMAGE FORMING APPARATUS HAVING FIXING DEVICE WITH DIFFERENTIAL PRESSURE AT OUTLET AND INLET

(71) Applicant: FUJI XEROX CO., LTD., Tokyo (JP)

(72) Inventors: Yasuto Okabayashi, Kanagawa (JP); Toshiyuki Miyata, Kanagawa (JP); Satoshi Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 81 days.

(21) Appl. No.: 13/853,537

(22) Filed: Mar. 29, 2013

(65) Prior Publication Data

US 2014/0056627 A1 Feb. 27, 2014

(30) Foreign Application Priority Data

Aug. 24, 2012 (JP) ..... 2012-185655

(51) Int. Cl.
*G03G 15/20* (2006.01)

(52) U.S. Cl.
CPC ..... *G03G 15/2014* (2013.01); *G03G 15/2064* (2013.01); *G03G 2215/2038* (2013.01)

(58) Field of Classification Search
CPC ..... G03G 15/2064; G03G 2215/2022; G03G 2215/2035; G03G 15/2038
USPC ..... 399/328, 329, 330; 219/216
See application file for complete search history.

(56) References Cited

U.S. PATENT DOCUMENTS

| | | | | |
|---|---|---|---|---|
| 6,529,701 | B2 * | 3/2003 | Baba et al. | 399/307 |
| 6,983,119 | B2 * | 1/2006 | Nakayama | 399/341 |
| 7,010,256 | B2 | 3/2006 | Usui et al. | |
| 7,835,654 | B2 | 11/2010 | Fujimoto | |
| 2004/0234290 | A1 | 11/2004 | Tomatsu | |
| 2006/0039723 | A1 * | 2/2006 | Kitazawa et al. | 399/328 |
| 2007/0025784 | A1 | 2/2007 | Ito et al. | |

FOREIGN PATENT DOCUMENTS

| | | | |
|---|---|---|---|
| EP | 1 496 406 | A1 | 1/2005 |
| JP | A-2002-31921 | | 1/2002 |
| JP | A-2004-279702 | | 10/2004 |
| JP | 2005115027 | A * | 4/2005 |
| JP | 2007304406 | A * | 11/2007 |
| JP | A-2007-328046 | | 12/2007 |
| JP | 2009014989 | A * | 1/2009 |
| JP | A-2010-145620 | | 7/2010 |

OTHER PUBLICATIONS

Jun. 19, 2014 Australian Office Action issued in Australian Application No. 2013205404.

* cited by examiner

*Primary Examiner* — Robert Beatty
(74) *Attorney, Agent, or Firm* — Oliff PLC

(57) ABSTRACT

A fixing device includes a fixing rotary body that heats toner while rotating and fixes the toner on a recording medium, a pressurizing rotary body that sandwiches and pressurizes the toner and the recording medium by the fixing rotary body, and a supporting part that supports the fixing rotary body from the inside so that a peak pressure on an outlet side of the recording medium becomes equal to or lower than a peak pressure on an inlet side, in a contact part where the fixing rotary body and the pressurizing rotary body come into contact with each other.

8 Claims, 9 Drawing Sheets

PRESENT EMBODIMENT

PRESENT EMBODIMENT

COMPARATIVE EXAMPLE

IMAGE FORMING APPARATUS HAVING FIXING DEVICE WITH DIFFERENTIAL PRESSURE AT OUTLET AND INLET

CROSS-REFERENCE TO RELATED APPLICATIONS

This application is based on and claims priority under 35 USC 119 from Japanese Patent Application No. 2012-185655 filed Aug. 24, 2012.

BACKGROUND

Technical Field

The present invention relates to a fixing device, and an image forming apparatus.

SUMMARY

According to an aspect of the invention, there is provided a fixing device including a fixing rotary body that heats toner while rotating and fixes the toner on a recording medium; a pressurizing rotary body that sandwiches and pressurizes the toner and the recording medium by the fixing rotary body; and a supporting part that supports the fixing rotary body from the inside so that a peak pressure on an outlet side of the recording medium becomes equal to or lower than a peak pressure on an inlet side, in a contact part where the fixing rotary body and the pressurizing rotary body come into contact with each other.

BRIEF DESCRIPTION OF THE DRAWINGS

Exemplary embodiments of the present invention will be described in detail based on the following figures, wherein.

DETAILED DESCRIPTION

Figure 1:
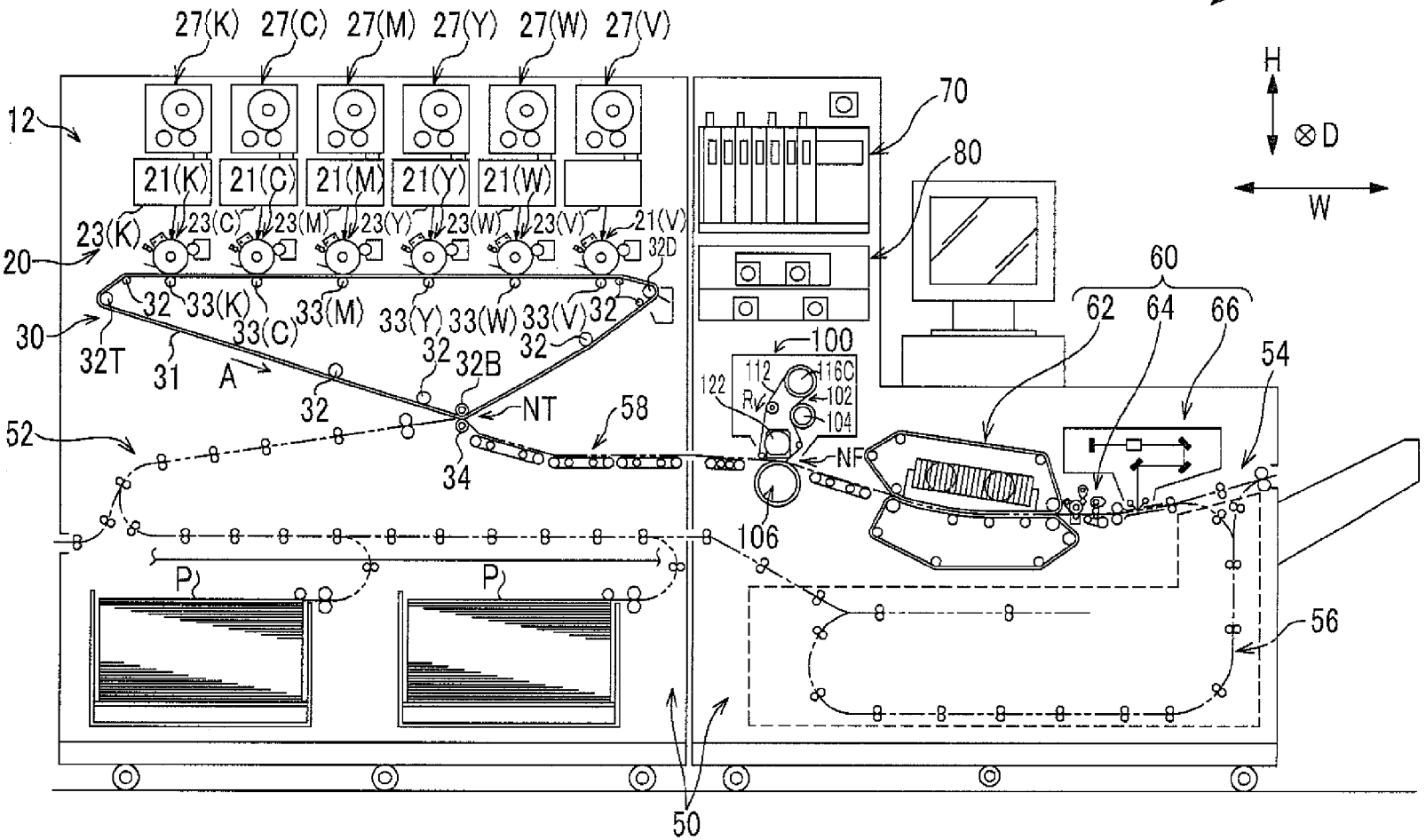
FIG. 1 is a schematic view showing the overall configuration of an image forming apparatus related to a present exemplary embodiment.

An example of an exemplary embodiment of the invention will be described below with reference to the drawings. The overall configuration and operation of an image forming apparatus will first be described, the configuration and operation of a fixing device will next be described, and main parts of the present exemplary embodiment will then be described. In addition, in the following description, a direction shown by arrow H in FIG. 1 is defined as an apparatus height direction, and a direction shown by arrow W in FIG. 1 is defined as an apparatus width direction. Additionally, a direction (shown by D) orthogonal to the apparatus height direction and the apparatus width direction, respectively, is defined as an apparatus depth direction.

Overall Configuration of Image Forming Apparatus

FIG. 1 is a schematic view showing the overall configuration when an image forming apparatus 10 related to the present exemplary embodiment is viewed from the front side. As shown in this drawing, the image forming apparatus 10 is configured to include an image forming section 12 that forms an image on recording paper P as an example of a recording medium by an electrophotographic method, a medium transporting section 50 that transports the recording paper P, and a post-processing section 60 that performs post-processing or the like to the recording paper P on which an image is formed. Moreover, the image forming apparatus 10 is configured to include a controller 70 that controls the above respective sections, and a power source section 80 that supplies electric power to the above respective sections including the controller 70.

Configuration of Image Forming Section

Figure 2:
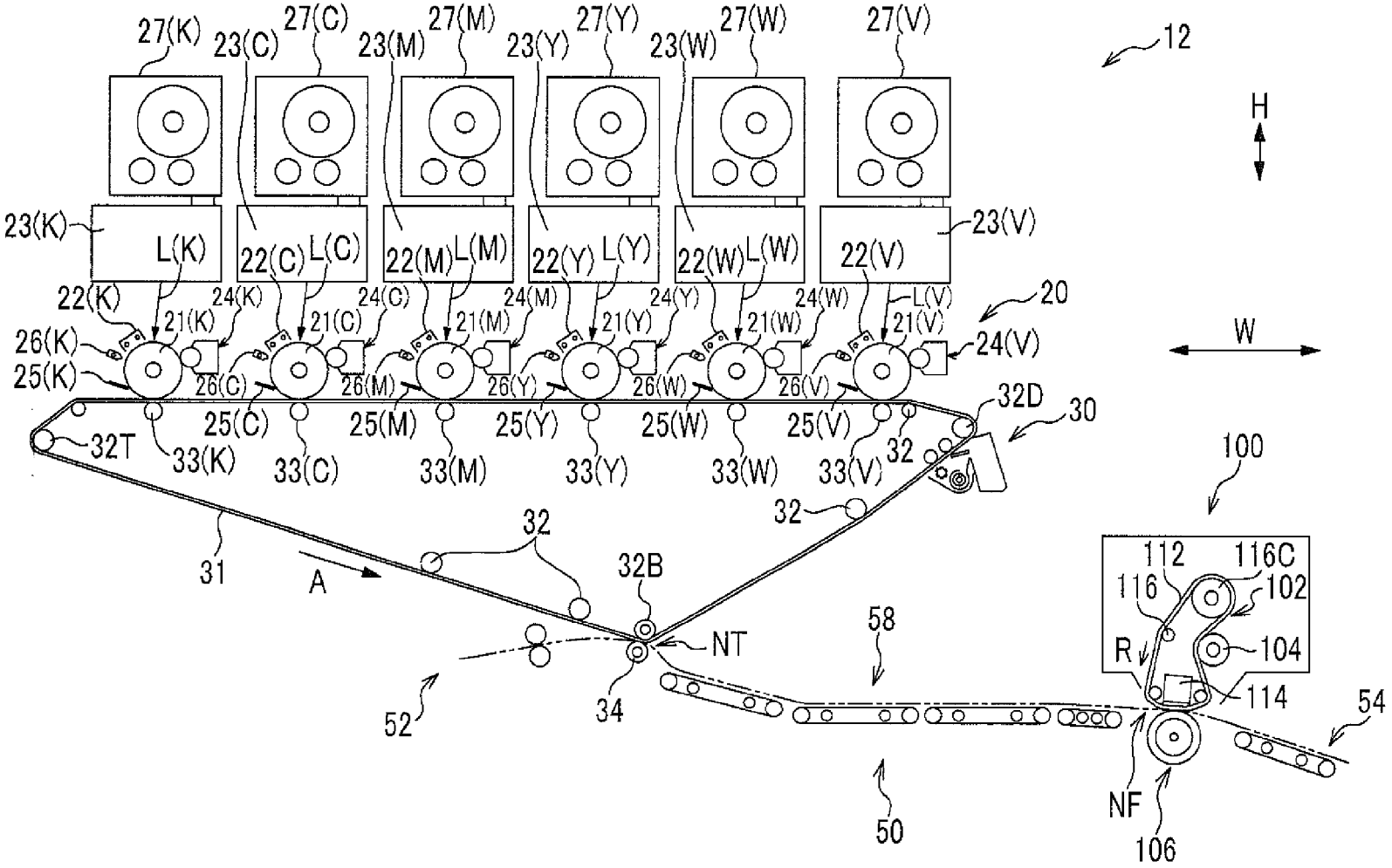
FIG. 2 is a schematic view showing the configuration of an image forming section related to the present exemplary embodiment.

As shown in FIG. 2, the image forming section 12 is configured to include a toner image forming section 20 that forms a toner image, a transfer device 30 that transfers the image formed by the toner image forming section 20 to the recording paper P, and a fixing device 100 that fixes the toner image, which is transferred to the recording paper P, on the recording paper P. The toner image forming section 20 is configured to include a photoconductor 21 that is an example of an image holding member holding a latent image (electrostatic latent image), a charger 22, an exposure device 23, a developing device 24, and a cleaning device 25.

Additionally, plural toner image forming sections 20 are provided so that a toner image is formed for every color, as an example. In the present exemplary embodiment, toner image forming sections 20 for a total of six colors of a first special color (V), a second special color (W), yellow (Y), magenta (M), cyan (C), and black (K) are provided. (V), (W), (Y), (M), (C), and (K) shown in FIG. 1 represent the above respective colors. The transfer device 30 transfers toner images equivalent to six colors from a transfer belt 31, to which the toner images equivalent to six colors are superimposed on each other and are primarily transferred, to the recording paper P in a transfer nip NT.

Photoconductor

A photoconductor 21 is formed in a cylindrical shape and rotationally driven around its own axis by a drive unit that is not shown. A photosensitive layer (not shown) having negative charging polarity as an example is formed on the outer peripheral surface of the photoconductor 21. In addition, a configuration in which an overcoat layer is formed on the outer peripheral surface of the photoconductor 21 may be adopted. The photoconductors 21 for respective colors are linearly arranged side by side along the apparatus width direction in plan view.

Charger

The charger 22 charges the outer peripheral surface (photosensitive layer) of the photoconductor 21 with negative polarity. In the present exemplary embodiment, a corona discharge type (non-contact charging type) scorotron charger is used as the charger 22.

Exposure Device

Figure 3:
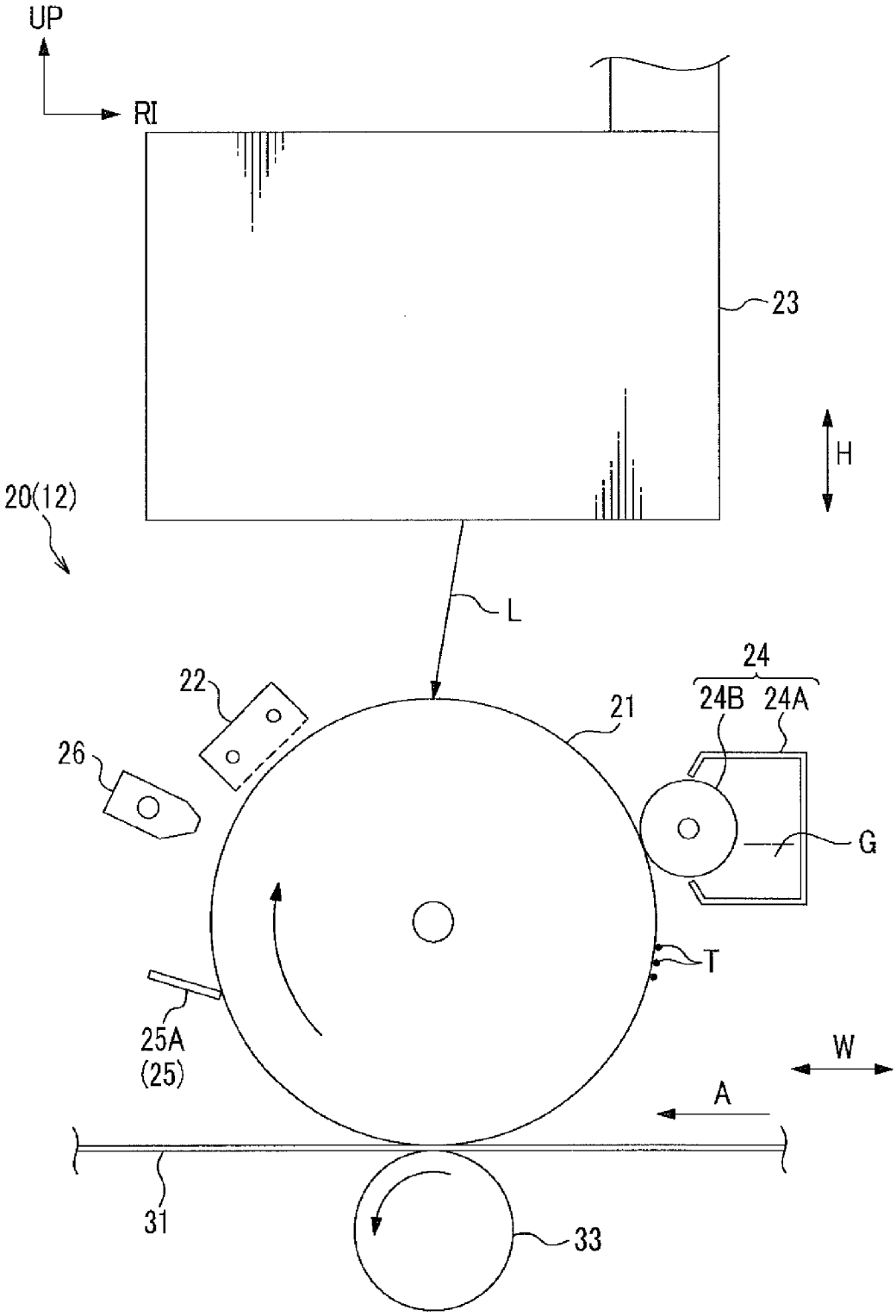
FIG. 3 is a schematic view showing the configuration of a toner image forming section related to the present exemplary embodiment.

The exposure device 23 forms an electrostatic latent image on the outer peripheral surface of the photoconductor 21. Specifically, modulated exposure light L (refer to FIG. 3) is irradiated to the outer peripheral surface of the photoconductor 21 charged by the charger 22 according to image data received from an image signal processing section (not shown) that constitutes the controller 70. An electrostatic latent image is formed on the outer peripheral surface of the photoconductor 21 by the irradiation of the exposure light L by the exposure device 23. In the present exemplary embodiment, the exposure device 23 is configured to expose the surface of the photoconductor 21 while performing scanning with a light beam irradiated from a light source by a light scanning unit (optical system) including a polygon mirror and Fθ lens. Additionally, in the present exemplary embodiment, the exposure device 23 is provided for every color.

Developing Device

The developing device 24 develops the electrostatic latent image formed on the outer peripheral surface of the photoconductor 21 with the developer G containing toner T, to thereby form a toner image on the outer peripheral surface of the photoconductor 21. Although details are omitted, the developing device 24 is configured to include at least a container 24A (refer to FIG. 3) that contains the developer G, and a developing roll 24B (refer to FIG. 3) that supplies the developer G contained in the container 24A to the photoconductor 21 while rotating the developer. A toner cartridge 27 for replenishing the developer G is connected to the container 24A via a replenishing passage that is not shown. The toner cartridges 27 for respective colors are arranged side by side in the apparatus width direction in plan view above the photoconductors 21 and the exposure devices 23, and are individually made replaceable.

Toner

The particle diameter of the toner T is made equal to or less than 4.5 [μm]. In the present exemplary embodiment, as an example, the particle diameter is 3.8 [μm]. In addition, the particle diameter of the toner T in the present exemplary embodiment is volume mean particle diameter D50v. As a method for measuring the volume average particle diameter D50v of the toner T, first, 0.5 [mg] or more and 50 [mg] or less of a measurement sample is added into 2 [ml] of a water solution with 5 weight [%] of a surfactant (preferably, alkyl benzenesulfonic acid sodium) as a dispersant, and this is added into 100 [ml] or more and 150 [ml] or less of an electrolyte. Dispersion treatment is performed to the electrolyte, having this measurement sample suspended therein, for about 1 minute by an ultrasonic dispersing unit, and the particle size distribution of particles whose particle diameter is within a range of 2.0 [μm] or more and 60 [μm] or less is measured using an aperture whose aperture diameter is 100 [μm], by a Coulter Multisizer II model (made by the Beckman Coulter, Inc.). The number of particles to be measured is 50,000. A cumulative distribution of the volume is subtracted from the small particle diameter side with respect to the particle size range (channel) divided on the basis of obtained particle size distribution, and the particle diameter at 50% accumulation is defined as a volume average particle diameter D50v.

In detail, the toner T is configured to include, for example, toner particles containing a binder resin, a coloring agent, and if needed, other additives such as a release agent, and if needed, an external additive. In addition, in the present exemplary embodiment, a two-component developer in which the developer G contains the toner T and a carrier (not shown) is used as an example. However, since the carrier is recovered in a development step and is not used in a fixing step, description of the carrier is omitted.

Examples of the binder resin are not particularly limited, but include homopolymers and copolymers, such as styrenes (for example, styrene, chlorostyrene, and the like), monoolefins (for example, ethylene, propylene, butylene, isoprene, and the like), vinyl esters (for example, vinyl acetate, vinyl propionate, vinyl benzoate, vinyl butyrate, and the like), α-methylene aliphatic monocarboxylic acid esters (for example, methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and the like), vinyl ethers (for example, vinyl methyl ether, vinyl ethyl ether, vinyl butyl ether, and the like), vinyl ketones (for example, vinyl methyl ketone, vinyl hexyl ketone, vinyl isopropenyl ketone, and the like); and polyester resins obtained by copolymerizing dicarboxylic acids and diols.

Particularly, representative examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene resin, polypropylene resin, polyester resin, and the like. Additionally, representative examples of the binder resin also include polyurethane, epoxy resin, silicone resin, polyamide, modified rosin, paraffin wax, and the like.

Representative examples of the coloring agent include magnetic powder (for example, magnetite and ferrite, and the like), carbon black, aniline blue, Calco Oil Blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, C. I. Pigment Blue 15:3, and the like.

Examples of the external additive include inorganic particles, and examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

Examples of the other additives include a release agent, magnetic substance, a charging control agent, inorganic powder, and the like. Examples of the release agent include hydrocarbon-based wax; natural waxes such as carnauba wax, rice wax, and candy lilac wax; synthetic or mineral/petroleum-based waxes such as montan wax; and ester-based waxes such as fatty acid ester and montanoic acid ester, but are not limited to these.

Next, the characteristics of the toner T (toner particles) will be described. The toner T has an average shape factor (the number average of a shape factor represented by Shape factor=$(ML^2/A)\times(\pi/4)\times100$, where ML represents the maximum length of a particle and A represents the projected area of the particle) of preferably 100 or more and 150 or less, more preferably 105 or more and 145 or less, and most preferably 110 or more and 140 or less. Additionally, the particle diameter (volume mean particle diameter D50v) of the toner T is preferably made equal to or less than 4.0 [μm] as already described.

In addition, in the present exemplary embodiment, the softening point of the toner T is 100 [° C.] or higher and 140 [° C.] or lower. Here, a flow tester: CFT500 (made by Shimadzu Corp.) is used, and ½ descending temperature (a temperature equivalent to ½ of the height from an outflow starting point to an ending point when a toner sample is made to melt and flow out) measured on the conditions that the diameter of dice pores is 0.5 [mm], pressurization load is 0.98 [MPa], and heating rate is 1 [° C./min] is used as the softening point of the toner T.

Here, the viscoelastic characteristics of the toner T are determined by the combination between the viscoelastic characteristics of resin to be used and the amount of ion cross-linking between resins. In the present exemplary embodiment, the viscoelastic characteristics are controlled by setting the softening point of the toner to a desired value. In detail, in the present exemplary embodiment, as an example, a low viscoelastic toner whose toner softening point is around 109 [° C.], a middle viscoelastic toner whose toner softening point is around 125 [° C.], and a high viscoelasticity toner whose toner softening point is around 140 [° C.] are obtained by adjusting the molecular weight of the toner T and the amount of aluminum cross-linking of the toner.

Recording Paper

As the recording paper P, as an example, recording paper in which the smoothness [sec] measured by Paper Pulp Test Method No. 5-2:2000 (paper and paperboard: smoothness and air permeability test method) of Japan Technical Association of the Pulp and Paper Industry is 740 [sec] or more and 2000 [sec] or less is used. In addition, setting of the smoothness is made on the basis of various evaluation results to be described below.

Cleaning Device

The cleaning device 25 includes a blade 25A that scrapes off the toner T, which remains on the surface of the photoconductor 21 after the transfer of the toner image to the transfer device 30, from the surface of the photoconductor 21. Although illustration is omitted, the cleaning device 25 is configured to further include a housing that recovers the toner T scraped off by the blade 25A, and a transporting device that transports the toner T within the housing to a waste toner box.

Transfer Device

The transfer device 30 superimposes toner images of the photoconductors 21 for respective colors on the transfer belt 31, primarily transfers the superimposed toner images, and secondarily transfers the superimposed toner images to the recording paper P.

Specifically, the transfer belt 31 forms an endless shape, and is wound around plural rolls 32, whereby the posture thereof is determined. In the present exemplary embodiment, the transfer belt 31 is adapted to take a reverse obtuse triangular posture that is elongate in the apparatus width direction in plan view. A roll 32D shown in FIG. 2 among the plural rolls 32 functions as a driving roll that circulates the transfer belt 31 in the direction of arrow A by the power of a motor that is not shown. Additionally, a roll 32T shown in FIG. 2 among the plural rolls 32 functions as a tension imparting roll that imparts tension to the transfer belt 31. A roll 32B shown in FIG. 2 among the plural rolls 32 functions as a facing roll of a secondary transfer roll 34.

Moreover, the transfer belt 31 comes into contact with the photoconductors 21 for respective colors from below at an upper side portion that extends in the apparatus width direction in the above-described posture, and the images of the respective photoconductor 21 are transferred under the application of a transfer bias voltage from a primary transfer roll 33. Additionally, the transfer belt 31 has the secondary transfer roll 34 brought into contact therewith at a top portion on the side of a lower end that forms an obtuse angle, to form a transfer nip NT, and receives the application of the transfer bias voltage from the secondary transfer roll 34 to transfer the toner images to the recording paper P that passes through the transfer nip NT.

Fixing Device

The fixing device 100 fixes the toner images on the recording paper P to which the toner images are transferred in the transfer device 30. In the present exemplary embodiment, the fixing device 100 is configured to pressurize and heat the toner images in a fixing nip NF to be described below and thereby fixes the toner images on the recording paper P. In addition, the details of the fixing device 100 will be described below.

Medium Transporting Section

As shown in view 1, the medium transporting section 50 is configured to include a medium supply part 52 that supplies the recording paper P to the image forming section 12, and a medium discharge part 54 that discharges the recording paper P on which an image is formed. Additionally, the medium transporting section 50 is configured to include a medium return part 56 that is used when images are formed on both surfaces of the recording paper P, and an intermediate transporting part 58 that transports the recording paper P from the transfer device 30 to the fixing device 100.

The medium supply part 52 is adapted to supply the recording paper P sheet by sheet to the transfer nip NT of the image forming section 12 in tune with transfer timing. The medium discharge part 54 is adapted to discharge the recording paper P (on which an image is formed), on which toner images are fixed in the fixing device 100, to the outside of the apparatus. The medium return part 56 reverses the front and back of the recording paper P, and returns the recording paper to the image forming section 12 (medium supply part 52) when an image is formed on the other surface of the recording paper P that has the toner images fixed on one surface.

Post-Processing Section

The post-processing section 60 is configured to include a medium cooling part 62 that cools the recording paper P on which an image is formed in the image forming sections 12, a correcting device 64 that corrects the bending of the recording paper P, and an image inspection part 66 that inspects the image formed on the recording paper P. Respective parts that constitute the post-processing section 60 are arranged in the medium discharge part 54 of the medium transporting section 50.

The medium cooling part 62, the correcting device 64, and the image inspection part 66 that constitute the post-processing section 60 are arranged in this order from the upstream side in the discharge direction of the recording paper P in the medium discharge part 54, and perform the above post-processing to the recording paper P in a discharge step by the medium discharge part 54.

Image Forming Operation

Next, the outline of an image forming step to the recording paper P by the image forming apparatus 10 and its post-processing step will be described.

As shown in FIG. 1, the controller 70 that has received an image forming command operates the toner image forming section 20, the transfer device 30, and the fixing device 100. Thereby, the photoconductor 21 and the developing roll 24B (refer to FIG. 3) are rotated, and the transfer belt 31 is circulated. Additionally, a pressurizing roll 106 to be described below is rotated, and the fixing belt 112 is circulated (driven). Moreover, the controller 70 operates the medium transporting section 50 or the like in synchronization with this operation.

Thereby, the photoconductors 21 for respective colors are charged by the chargers 22 while being rotated. Additionally, the controller 70 sends image data, which has been subjected to image processing in the image signal processing section, to the respective exposure devices 23. The respective exposure devices 23 emit exposure light L according to image data, and exposes the respective charged photoconductors 21 by the exposure light. Then, electrostatic latent images are formed on the outer peripheral surfaces of the respective photoconductors 21. The electrostatic latent images formed on the respective photoconductors 21 are developed with developer (toner) supplied from the developing devices 24. Thereby, toner images of corresponding colors among the first special color (V), the second special color (W), yellow (Y), magenta (M), cyan (C), and black (K) are formed on the photoconductors 21 for respective colors.

The toner images of the respective colors formed on the photoconductors 21 for respective colors are sequentially transferred to the circulating transfer belt 31 by the application of transfer bias voltages through the primary transfer rolls 33 for respective colors. Thereby, superimposed toner images in which the toner images equivalent to six colors are superimposed are formed on the transfer belt 31. The superimposed toner images are transported to the transfer nip NT by the circulation of the transfer belt 31. The recording paper P is supplied to the transfer nip NT by the medium supply part 52 in tune with the transport of the superimposed toner images. Then, the superimposed toner images are transferred to the recording paper P from the transfer belt 31 as a transfer bias voltage is applied to the transfer nip NT.

The recording paper P to which the toner images are transferred is transported toward the fixing nip NF of the fixing device 100 from the transfer nip NT of the transfer device 30 by the intermediate transporting part 58 while being suctioned with negative pressure. The fixing device 100 imparts heat and a pressurizing force (fixing energy) to the recording paper P that passes through the fixing nip NF. Thereby, the toner images transferred to the recording paper P are fixed on the recording paper P.

The recording paper P discharged from the fixing device 100 is subjected to processing by the post-processing section 60 while being transported toward a discharge medium receiving part outside the apparatus by the medium discharge part 54. The recording paper P heated by the fixing step is first cooled in the medium cooling part 62. Next, the bending of the recording paper P is corrected by the correcting device 64. Moreover, as for the toner images fixed on the recording paper P, the presence/absence or degree of a toner concentration defect, an image defect, an image position defect, and the like are detected by the image inspection part 66. Then, the recording paper P is transported to the medium discharge part 54.

On the other hand, in a case where an image is formed on a non-image surface of the recording paper P on which an image is not formed (in the case of double-sided printing), the controller 70 switches the transporting path of the recording paper P after the passage of the image inspection part 66 from the medium discharge part 54 to the medium return part 56. Thereby, the recording paper P has the front and back reversed, and is fed to the medium supply part 52. An image is formed (fixed) on the rear surface of the recording medium in the same step as the image forming step to the above surface. This recording paper P undergoes the same process as the post-processing step after the formation of an image to the above surface, and is discharged to the outside of the apparatus by the medium discharge part 54.

Configuration of Main Parts

Figure 4:
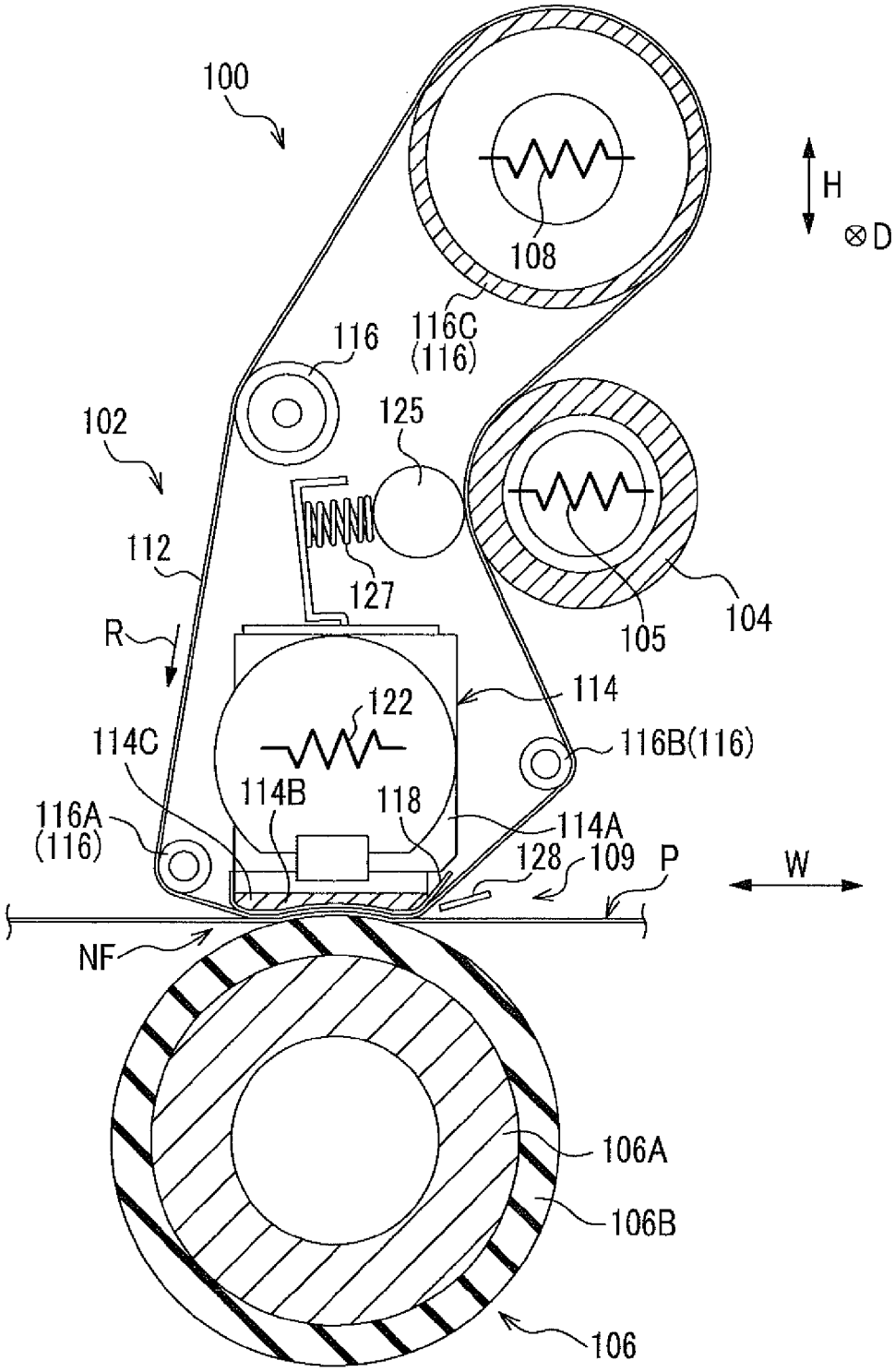
FIG. 4 is a schematic view showing the configuration of a fixing device related to the present exemplary embodiment.

As shown in FIG. 4, the fixing device 100 is configured to include a fixing belt module 102 having a fixing belt 112 as an example of a fixing rotary body to be described below, an external roll 104 provided outside the fixing belt 112, a pressurizing roll 106 as an example of a pressurizing rotary body that sandwiches and pressurizes the toner T and the recording paper P by the fixing belt 112, and a pad member 114 as an example of a supporting part that supports the fixing belt 112 from the inside so that the pressure on the outlet side of the recording paper P becomes equal to or lower than the pressure on the inlet side of the recording paper.

Additionally, in the fixing device 100, the fixing belt 112 and the pressurizing roll 106 come into contact with each other, and form the fixing nip NF as an example of a contact part. In the present exemplary embodiment, the pressure (pressurizing force) that the fixing nip NF acts is within a range that is greater than 0 [Pa]. The width from an inlet to an outlet in the fixing nip NF is W (refer to FIG. 5). Moreover, the fixing device 100 is configured to include a halogen lamp 108 that heats the fixing belt 112, and a peeling pad mechanism 109 for peeling the tip of the recording paper P passed through the fixing nip NF from the fixing belt 112.

Figure 5:
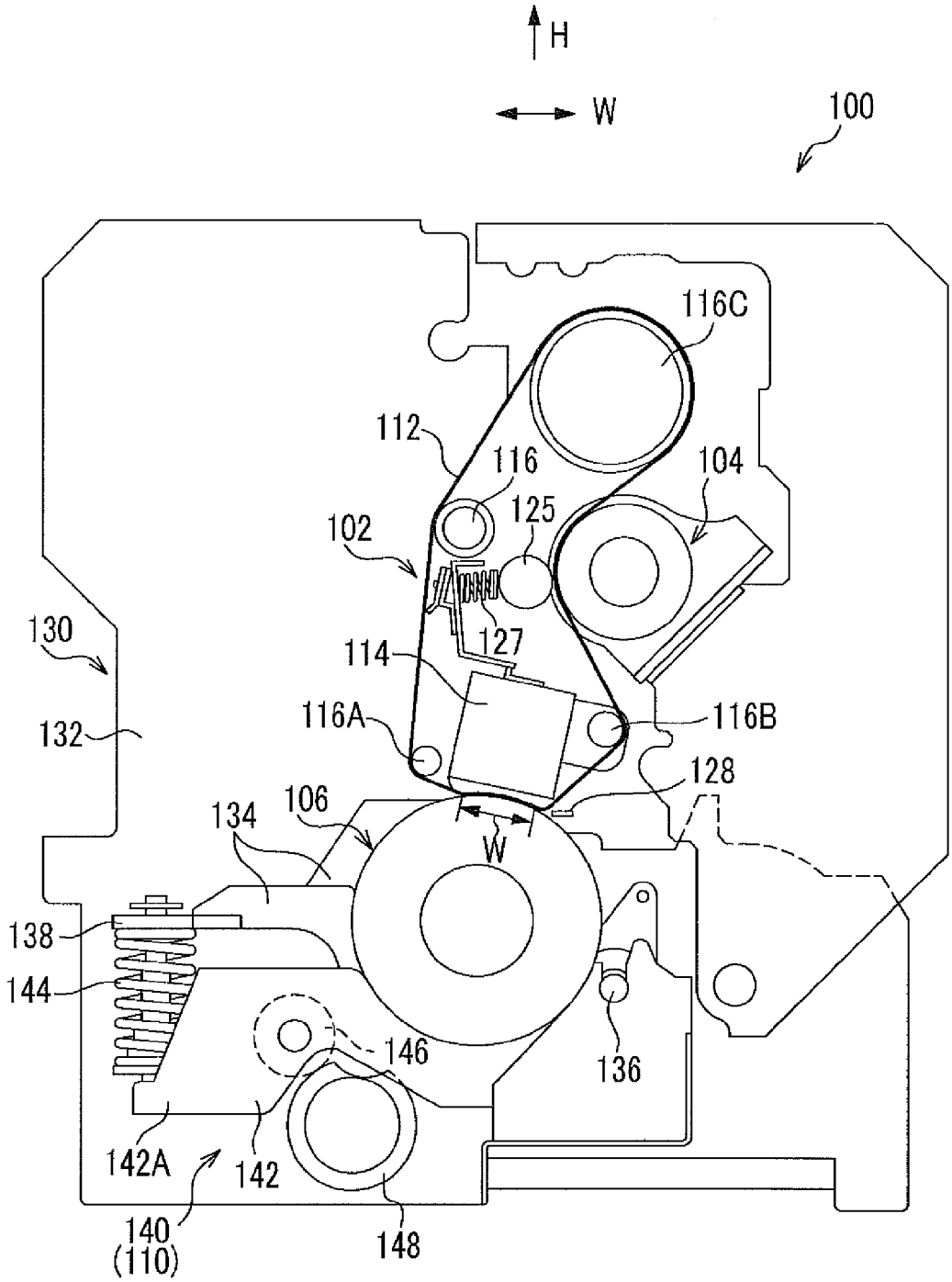
FIG. 5 is a schematic view showing a contact state of a pressurizing roll to a fixing belt by a position switching mechanism in the fixing device related to the present exemplary embodiment.

As shown in FIG. 5, the pressurizing roll 106 is pressurized toward the fixing belt 112 and the pad member 114 by a switching mechanism 140. In addition, the details of the switching mechanism 140 will be described below.

As shown in FIG. 4, the fixing belt module 102 includes the fixing belt 112 that heats the toner T and fixes the toner on the recording paper P, the pad member 114 that is elongated in the apparatus depth direction, and plural rolls 116 that have the direction of rotation axes in the apparatus depth direction, respectively.

The fixing belt 112 forms an annular (endless) shape that opens to both sides in the apparatus depth direction orthogonal to the transporting direction of the recording paper P. The fixing belt 112 takes a posture that is wound and determined around the pad member 114, the plural rolls 116, and the external roll 104, and circulates in the direction of arrow R shown by FIG. 4 (on a circulating track along the posture) while the posture is maintained. In addition, the frictional coefficient between the fixing belt 112 and the image forming surface of the recording paper P is defined as $\mu$.

The pad member 114 is configured to include a main body 114A and a pad 114B that is fixed to the undersurface of the main body 114A and comes into contact with the fixing belt 112, and is fixed (arranged) inside the fixing belt 112 so that the fixing belt 112 comes into contact with and slides on the undersurface of the pad 114B. The pad member 114 receives the pressing (nip) load from the pressurizing roll 106 in a nip forming surface 114C that constitutes a surface of the pad 1140 on the fixing belt 112 side, and thereby forms the fixing nip NF as already described between the fixing belt 112 and the pressurizing roll 106. In addition, since the main body 114A is fixed to an apparatus frame 130 (refer to FIG. 5), the pad member 114 does not follow the circulation of the fixing belt 112. That is, the fixing belt 112 slides on the pad member 114 as already described.

The nip forming surface 114C of the pad member 114 is formed as a curved surface that is concaved in a circular-arc shape on the pressurizing roll 106 side as viewed from the apparatus depth direction. By virtue of this shape, the pad member 114 forms the fixing nip NF that is elongate in the transporting direction of the recording paper P as compared to a configuration in which a roll that supports a nip load is provided between the fixing belt 112 and the pressurizing roll 106 instead of the pad member 114.

A sliding sheet 118 is interposed between the fixing belt 112 and the nip forming surface 114C of the pad member 114. The surface of the sliding sheet 118 that comes into contact with at least the fixing belt 112 is made of, for example, low-friction materials, such as fluororesin. This provides a configuration in which frictional resistance around the fixing belt 112 is reduced.

Additionally, a halogen lamp 122 that is an example of a heating source is provided within the main body 114A of the pad member 114. The pad member 114 functions also as a heat transfer member that transfers heat, which has been radiated from the halogen lamp 122, to the fixing belt 112 via the nip forming surface 114C.

Rolls 116A and 116B that are located on both upstream and downstream sides in the circulating direction of the fixing belt 112 with respect to the pad member 114 among the plural rolls 116 function as posture correcting rolls. Specifically, the respective rolls 116A and 116B are adapted to suppress changes in the circulating direction of the fixing belt 112 before and after the fixing nip NF (makes the bending angle of the fixing belt 112 at both ends of the fixing nip NF obtuse).

A roll 1160 that is located farthest from the pad member 114 along the plural rolls 116 functions as an internal heating roll that heats the fixing belt 112 from the inner peripheral side. Specifically, the roll 1160 has the fixing belt 112 wound therearound from the inner peripheral side, and transmits heat, which has been radiated from the halogen lamp 108 provided inside the roll, to the fixing belt 112. In the present exemplary embodiment, the roll 116C functions also as a steering roll that may tilt its axis in the apparatus depth direction to thereby adjust the position of the fixing belt 112 in the width direction (apparatus depth direction).

The pressurizing roll 106 is configured, as an example, so that an elastic body layer 106B made of silicone rubber is coated on the outer periphery of a columnar roll body 106A made of aluminum. Although illustration is omitted, a release layer whose outer peripheral surface is made of fluororesin or the like of a film thickness of 100 μm is formed on the outer periphery of the elastic body layer 106B. The pressurizing roll 106 functions as a driving roll that is rotated by a driving source that is not shown, to thereby apply a driving force F (refer to FIG. 6A) for circulation to the fixing belt 112.

Additionally, the fixing device 100 includes the external roll 104 as already above around which the fixing belt 112 is wound from the outer peripheral side. The external roll 104 is arranged between the roll 116E and the roll 116C on the downstream side of the pad member 114, in the circulating direction of the fixing belt 112. The external roll 104 functions as an external heating roll that heats the fixing belt 112 from the outer peripheral side. Specifically, the external roll 104 transmits heat, which has been radiated from the halogen lamp 105 provided in the external roll, to the fixing belt 112. Additionally, the external roll 104 functions as a driving roll that is rotated by a driving source that is not shown, to thereby apply a driving force for circulating to the fixing belt 112. In the present exemplary embodiment, the pressurizing roll 106 is used as a main driving roll that mainly applies a driving force to the fixing belt 112, and the external roll 104 is regarded as an auxiliary driving roll.

Additionally, the fixing belt module 102 includes a pressing roll 125 that presses the fixing belt 112 against the external roll 104 from the inner peripheral side. The pressing roll 125 presses the fixing belt 112 against the external roll 104 with the load that is determined under the biasing of a spring 127. This provides a configuration that increases a frictional force that contributes to the transmission of a driving force from the external roll 104 to the fixing belt 112 as compared to a configuration that does not include the pressing roll 125.

The peeling pad mechanism 109 has a peeling pad 128 that is arranged downstream of the fixing nip NF in the transporting direction of the recording paper P, and causes the tip of the peeling pad 128 to approach the fixing nip NF.

The fixing belt module 102 is integrally attachable and detachable to the apparatus frame 130 (refer to FIG. 5) as a module constituted by the fixing belt 112, the pad member 114, the respective rolls 116, and the like.

Basic Operation of Fixing Device

The fixing device 100 is prepared to operate by a command from the controller 70 prior to the operation of image formation (transfer) to the recording paper P in the image forming section 12. Specifically, the fixing belt 112 circulates along a predetermined track by the driving of the pressurizing roll 106 and the external roll 104. Additionally, the temperature of the fixing belt 112 rises to a predetermined temperature range by the heat generation of the halogen lamps 105, 108, and 122, and is maintained in the temperature range. The fixing belt 112 is heated while circulating, whereby the temperatures of respective parts thereof are brought into predetermined ranges.

Subsequently, if the recording paper P on which the toner images are transferred in the transfer device 30 is introduced into the fixing nip NF by the intermediate transporting part 58 as shown in FIG. 4, the fixing device 100 adds pressure and heat (fixing energy) to the recording paper P while transporting the recording paper P. Thereby, the toner images are fixed on the recording paper P.

Additionally, the tip of the recording paper P that has passed through the fixing nip NF enters between the peeling pad 128 of the peeling pad mechanism 109, and the pressurizing roll 106. Specifically, the fixing belt 112 circulates along an R shape (and a circulating track formed by the downstream roll 116B) formed at a downstream end portion in the transporting direction of the recording paper P in the nip forming surface 114C of the pad member 114, so as to separate from the transporting path of the recording paper P. For this reason, the tip of the recording paper P separates from the fixing belt 112 by its stiffness (restoration) (does not follow the track of the fixing belt 112), and enters between the peeling pad 128 of the peeling pad mechanism 109, and the pressurizing roll 106. Then, the recording paper P is peeled from the fixing belt 112 as being transported. The recording paper P fed out from the fixing device 100 in this way is transported to the downstream side (post-processing section 60 (refer to FIG. 1) side).

Position Switching Mechanism of Pressurizing Roll

The fixing device 100 of the above configuration is configured so that the pressurizing roll 106 is brought into contact with or separated from the fixing belt module 102 by the switching mechanism 140 to be described below. Specifically, the pressurizing roll 106 is configured so as to be switchable between a contact position where the pressurizing roll is brought into contact with the fixing belt 112 to form the fixing nip NF as shown in FIG. 5, and a separation position where the pressurizing roll is separated from the fixing belt 112, though illustration is omitted.

The fixing device 100 includes the apparatus frame 130. The apparatus frame 130 is configured to include a stationary frame 132, and a movable frame 134 that is displaced relative to the stationary frame 132. In the present exemplary embodiment, the movable frame 134 is made rotatable relative to the stationary frame 132 around a pivot 136 having an axial direction in the apparatus depth direction.

The stationary frame 132 fixedly supports the pad member 114 that constitutes the fixing belt module 102, and supports the respective rolls 116 so as to be rotatable around their respective axes. Thereby, the fixing belt module 102 is configured so as not to be displaced relative to the stationary frame 132 except for the operation around the fixing belt 112 and the rotational operation of the respective rolls 116.

On the other hand, the pressurizing roll 106 is rotatably supported by the movable frame 134. The pressurizing roll 106 is adapted so that the position thereof is switched to any of the contact position shown in FIG. 5 and the separation position (not shown) as the movable frame 134 rotates around the pivot 136 with respect to the stationary frame 132.

More specifically, the movable frame 134 has a load input part 138 that is arranged opposite to the pivot 136 across the pressurizing roll 106 in the apparatus longitudinal direction. The pressurizing roll 106 is adapted to be held in the contact position by adding an upward load to the load input part 138. This holding load is supported by the stationary frame 132 via the pad member 114. Additionally, if the upward load to the load input part 138 is removed, the pressurizing roll 106 is configured to rotate downward around the pivot 136 together with the movable frame 134 under its own weight and be moved to the separation position side. In addition, the pressurizing roll 106 may be configured to be moved to the separation position side by the restoring force of an elastic member that is not shown.

The switching mechanism 140 is configured to switch a state where an upward load is applied to the load input part 138 of the movable frame 134 and a state where this load is removed. Hereinafter, specific description will be made.

The switching mechanism 140 includes a push arm 142. The push arm 142 is rotatably supported around the pivot 136 with respect to the stationary frame 132 together with the movable frame 134. The other end portion 142A of the push arm 142 is arranged below the load input part 138 of the movable frame 134, and a compression coil spring 144 is interposed between the other end portion and the load input part 138.

Additionally, an inner ring of a bearing 146 that functions as a cam follower is fixed between the pivot 136 and the compression coil spring 144 in the push arm 142. The switching mechanism 140 includes a cam 148 that supports the push arm 142 from below while coming into contact with an outer ring of the bearing 146. The cam 148 is rotatably supported by the stationary frame 132, and is rotated by a motor that is not shown.

Here, in a state where a major-axis portion of the cam 148 comes into contact with the outer ring of the bearing 146, as shown in FIG. 5, the push arm 142 is brought into a substantially horizontal posture, and the pressurizing roll 106 is located at the contact position. In this state, the upward load according to the amount of compression of the compression coil spring 144 is added to the load input part 138 of the movable frame 134. That is, the pressurizing roll 106 is adapted to come into contact with the fixing belt 112 with nip pressure within a predetermined range.

On the other hand, in a state where a minor-axis portion of the cam 148 comes into contact with the outer ring of a bearing 146, though illustration is omitted, the push arm 142 is brought into a posture that is tilted in a direction in which the other end portion 142A descends, and the extension of the compression coil spring 144 is limited by a stopper that is not shown. For this reason, the pressurizing roll 106 is separated from the fixing belt 112 under its own weight, and the upward load is removed from the load input part 138 of the movable frame 134. In this state, the pressurizing roll 106 and the movable frame 134 are adapted to be held at the separation position (lower movement limit) via the push arm 142 and the cam 148.

If the above is summarized, in the fixing device 100, the position of the pressurizing roll 106 with respect to the fixing belt 112 is selectively switched to any of the contact position and the separation position according to the rotational position of the cam 148 of the switching mechanism 140. Also, in the present exemplary embodiment, the pressurizing roll 106 is located at the separation position by the control of the controller 70 at the stop of the image forming apparatus 10, at the warm-up of the fixing device 100, or the like.

Additionally, in the fixing device 100, the pressurizing roll 106 comes into contact with the pad 114B in order of the inlet side and outlet side of the fixing nip NF as the load input part 138 side of the movable frame 134 rotates upward around the pivot 136. Thereby, the elastic body layer 106B (refer to FIG. 4) of the pressurizing roll 106 is elastically deformed, and the pressure on the outlet side of the recording paper P in the fixing nip NF becomes equal to or lower than the pressure on the inlet side.

The roll 116A that is located on the upstream side in the circulating direction of the fixing belt 112 at the fixing nip NF out of the two rolls 116A and 116B is arranged inside the fixing belt 112 so as to lie next to the pad member 114 on the upstream side in the transporting direction of the recording paper P to the fixing nip NF. The fixing belt 112 wound around the roll 116A is used as a track where a circulating track to the fixing nip NF runs along the transporting path of the recording paper P (brought close to parallelism). For this reason, the bending angle (track) of the fixing belt 112 before and after the fixing nip NF is made obtuse.

Pressure Distribution within Fixing Nip

Figure 6A:
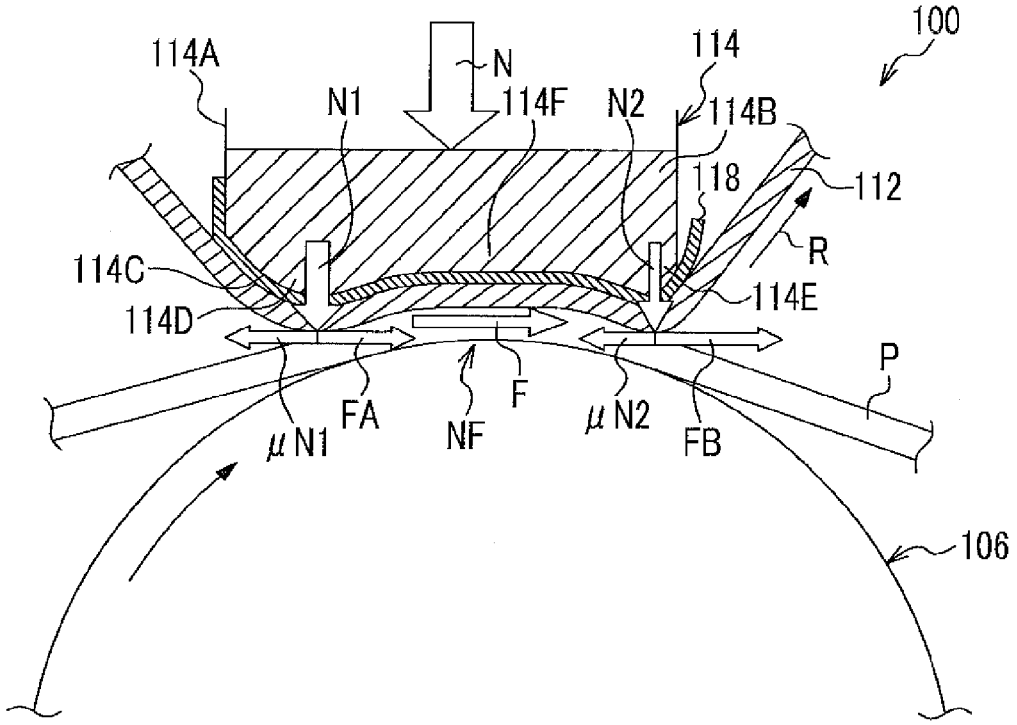
FIG. 6A is a schematic view showing forces that act on the inlet side and outlet side of a nip part related to the present exemplary embodiment.

As shown in FIG. 6A, a first convex portion 114D and a second convex portion 114E that are made convex toward the pressurizing roll 106 are formed on the fixing belt 112 (sliding sheet 118) side of the pad 114B. That is, the surface of the first convex portion 114D and the surface of the second convex portion 114E are included in the nip forming surface 114C as already described.

The first convex portion 114D is formed on the inlet side (on the left side in the drawing or the entrance side of the recording paper P) of the fixing nip NF. Additionally, the second convex portion 114E is formed on the outlet side (on the right side in the drawing and the discharge side of the recording paper P) of the fixing nip NF. A concave portion 114F that is made concave toward the main body 114A is provided between the first convex portion 114D and the second convex portion 114E.

Here, the pressurizing roll 106 comes into contact with the pad 114B by the switching mechanism 140 in order of the inlet side and outlet side of the fixing nip NF (refer to FIG. 5). This elastically deforms the elastic body layer 106B (refer to FIG. 4) of the pressurizing roll 106, and the load N (a reaction force against a force that acts by the contact with the pressurizing roll 106) that acts on the pad 114B acts on a part, which faces the first convex portion 114D of the fixing nip NF, as a peak load N1 and acts a part, which faces the second convex portion 114E, as a peak load N2. Peak load N1>peak load N2 is established.

Figure 6B:
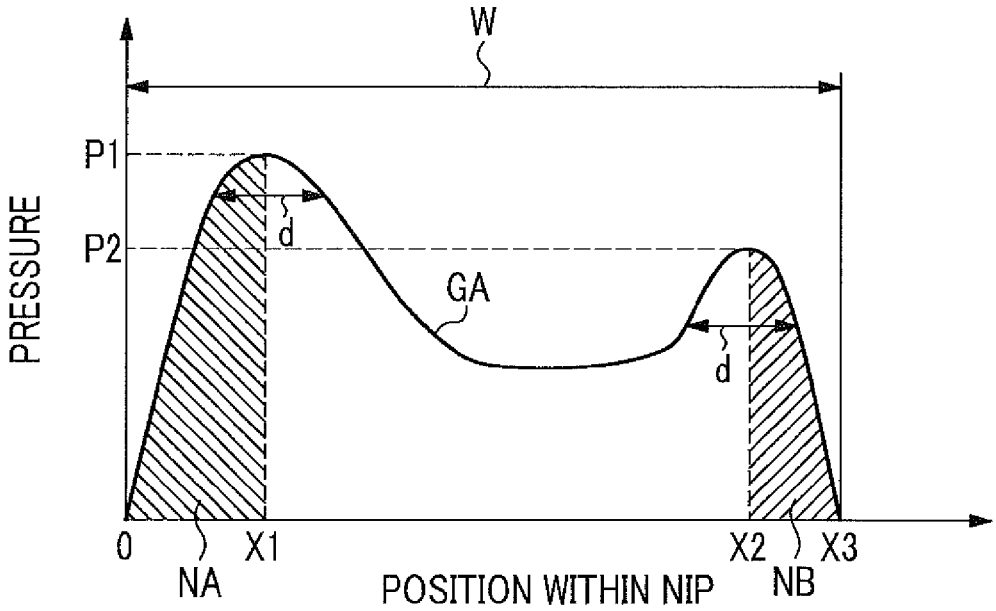
FIG. 6B is a graph showing the pressure distribution within the nip part related to the present exemplary embodiment.

Pressures (load per unit area) at respective positions within the fixing nip NF (refer to FIG. 6A) of width W are shown as a pressure distribution on a graph GA in FIG. 6B. Within the fixing nip NF, a peak pressure at a position X1 (almost at a middle position of the first convex portion 114D) becomes P1 [Pa], and a peak pressure at a position X2 (almost at a middle position of the second convex portion 114E) becomes P2

[Pa]. In addition, the peak pressures P1 and P2 are peak values in a reference width d (27 [mm] as an example) in the transporting direction of the recording paper P within the fixing nip NF.

In the present exemplary embodiment, as an example, the pressure (peak pressure P1) on the inlet side that acts on the recording paper P at a position that faces a top portion of the first convex portion 114D becomes 392 [kPa] or higher and 589 [kPa] or lower, and the pressure (equivalent to the peak pressure P2) on the outlet side that acts on the recording paper P at a position that faces a top portion of the second convex portion 114E becomes 294 [Pa] or higher and 392 [Pa] or lower. That is, the outlet-side pressure becomes lower than the inlet-side pressure (or equal to or lower than the inlet-side pressure). In addition, setting of the respective pressures on the inlet side and outlet side of the fixing nip NF is made on the basis of various evaluation results to be described below.

Additionally, in the present exemplary embodiment, as an example, the integration value (equivalent to a hatched region) of pressures (graph GA) from a position 0 (pressure=0 [Pa]) to a position X1 (pressure=P1 [Pa]) becomes NA (load) within the fixing nip NF (refer to FIG. 6A). Additionally, the integration value (equivalent to a hatched region) of pressures (graph GA) from a position X2 (pressure=P2 [Pa]) to a position X3 (pressure=0 [Pa]) becomes NB (load). NA>NB is established.

Various Evaluation Results

The evaluation results of melting unevenness (the contrast difference between the base of the recording paper P and the toner T) when changing the softening point [° C.] of the toner T, the smoothness [sec] of the recording paper P, the input-side pressure of the fixing nip NF, and the output-side pressure of the fixing nip NF is shown from Table 1 to Table 4. In addition, parameters to be changed are one type, respectively and other parameters except the parameters to be changed have the same setting. Additionally, evaluation of the melting unevenness is visually performed in five steps regarding the recording paper P (including toner images) after fixing, and the five steps includes a step (XX) where the unevenness is considerably conspicuous, a step (X) where the unevenness is partially present, a step (Δ) where the unevenness is not visually perceived, a step (O) where the unevenness is hardly seen, and a step (OO) where the unevenness is not seen at all.

On the basis of the evaluation results of the following Tables 1 to 4, in the present exemplary embodiment, the softening point of the toner T is 100 [° C.] or higher and 140 [° C.] or lower, the smoothness showing the surface state of the recording paper P is 740 [sec] or more and 2000 [sec] or less, the pressure on the inlet side of the fixing nip NF is 392 [kPa] or higher and 589 [kPa] or lower, and the pressure on the outlet side is 294 [kPa] or higher and 392 [kPa] or lower.

TABLE 1

| | Softening Point | | | |
|---|---|---|---|---|
| | 95° C. | 100° C. | 125° C. | 140° C. |
| Melting Unevenness | X | Δ | ○ | ○○ |

TABLE 2

| Recording Paper | A | B | C | D |
|---|---|---|---|---|
| Type | Recycled Paper | Plain Paper | Quasi-Coating Paper | Coating Paper |

TABLE 2-continued

| Recording Paper | A | B | C | D |
|---|---|---|---|---|
| Smoothness | 34 sec | 101 sec | 740 sec | 2000 sec |
| Melting Unevenness | XX | X | Δ | ○ |

TABLE 3

| | Inlet Pressure | | | |
|---|---|---|---|---|
| | 294 kPa | 392 kPa | 490 kPa | 589 kPa |
| Melting Unevenness | X | Δ | ○ | ○○ |

TABLE 4

| | Outlet Pressure | | |
|---|---|---|---|
| | 196 kPa | 294 kPa | 392 kPa |
| Melting Unevenness | X | Δ | ○ |

Configuration of Comparative Example

Next, a comparative example will be described.

Figure 8:
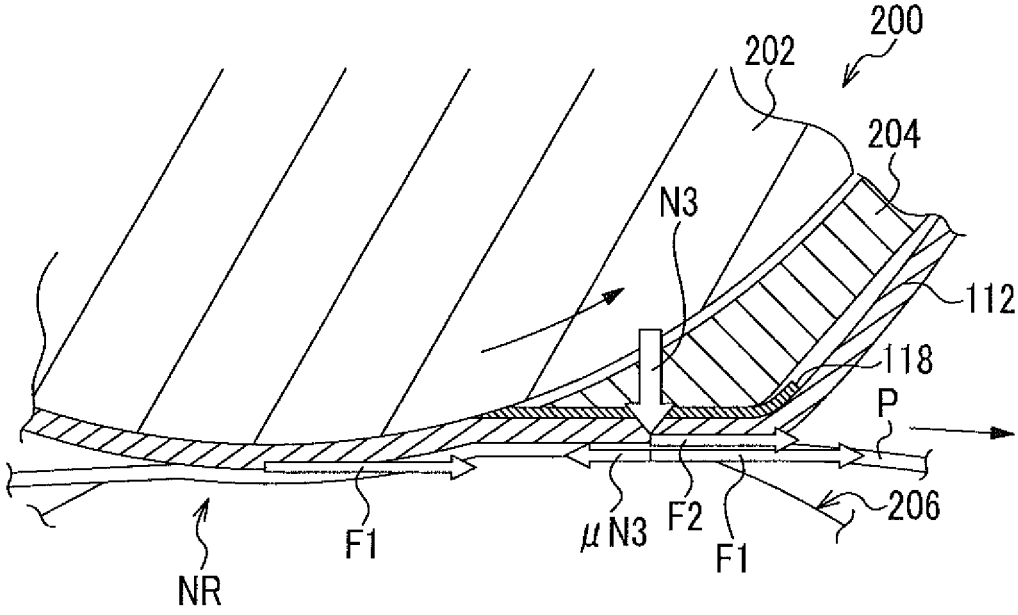
FIG. 8 is a schematic view showing forces that act on the inlet side and outlet side of the nip part related to the comparative example.

A fixing device 200 as a comparative example with respect to the fixing device 100 (refer to FIG. 6A) of the present exemplary embodiment is shown in FIG. 8. In addition, the members having the same configuration as those of the present exemplary embodiment are designated by the same reference numerals as the present exemplary embodiment, and the description thereof is omitted.

The fixing device 200 has the fixing belt 112, and a pressurizing roll 206 that comes into contact with the fixing belt 112 and forms a fixing nip NR. A heat roll 202 is provided on the inlet side of the fixing nip NR inside the fixing belt 112, and a peeling pad 204 is provided on the outlet side. The fixing belt 112 is driven by the heat roll 202, and the pressurizing roll 206 rotates in a following manner.

The heat roll 202 has a rotation axis along an axial direction of the fixing belt 112, and sandwiches the fixing belt 112 together with the pressurizing roll 206. Additionally, the peeling pad 204 is arranged on the outlet side of the fixing nip NR between the heat roll 202 and the fixing belt 112, and the cross-sectional shape of a lower part as viewed in the axial direction of the fixing belt 112 is an obtuse shape on the heat roll 202 side and an obtuse shape on the outlet side of the fixing nip NR. Moreover, the sliding sheet 118 is provided between the undersurface of the peeling pad 204, and the fixing belt 112. The peeling pad 204 (sliding sheet 118) sandwiches the fixing belt 112 together with the pressurizing roll 106.

Additionally, the length (width) of the heat roll 202, the fixing belt 112, the peeling pad 204, and the pressurizing roll 206 in the direction of the rotation axis of the heat roll 202 becomes longer than the width of the recording paper P. Thereby, in the fixing device 200, even in a state where the recording paper P is sandwiched, the driving force F1 of the heat roll 202 is transmitted to the pressurizing roll 206 irrespective of the inlet side and outlet side of the fixing nip NR.

Here, in the fixing device 200 of the comparative example, the driving force F1 of the heat roll 202 acts on the recording paper P in the fixing nip NR while fixing is performed to the recording paper P. Since the pressurizing roll 206 and the heat roll 202 rotate in the same direction in a range (including the inlet side of the fixing nip NR) where the heat roll 202 and the pressurizing roll 206 face each other across the fixing belt 112, there is little influence of a frictional force caused by the contact between the fixing belt 112 and the recording paper P, and the driving force that acts on the recording paper P becomes almost F1.

Subsequently, although the pressurizing roll 206 moves in a range (containing the outlet side of the fixing nip NR) where the peeling pad 204 and the pressurizing roll 206 face each other across the fixing belt 112, a frictional force acts between the fixing belt 112 and the recording paper P because the peeling pad 204 is fixed. Specifically, if the load that acts on the fixing nip NR is N3, a frictional force μN3 acts on the recording paper P in a direction opposite to the action direction of the driving force F1, using the frictional coefficient μ as already described. Thereby, the driving force of the recording paper P becomes F1 on the inlet side of the fixing nip NR, the driving force of the recording paper P becomes F2 (=F1−μN3) on the outlet side, and the movement speed of the recording paper P decreases on the outlet side.

Figure 7A:
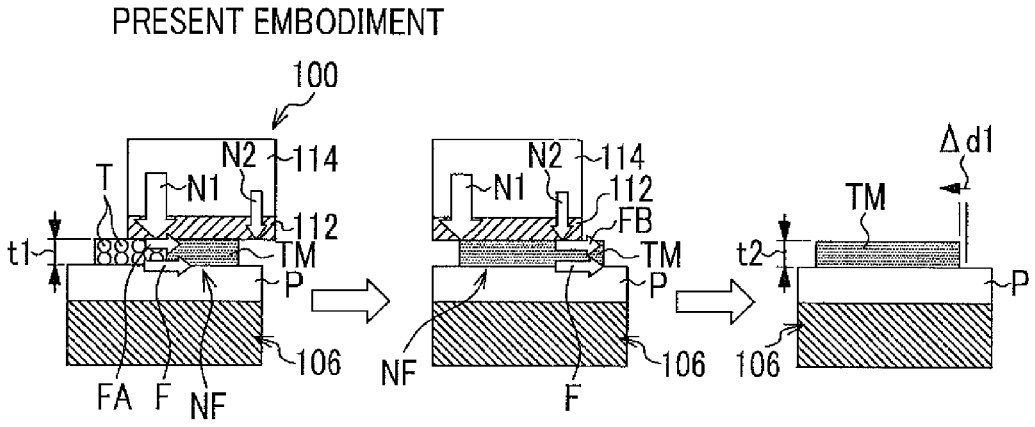
FIG. 7A is an explanatory view showing a state where recording paper enters the inlet side of the nip part related to the present exemplary embodiment and is discharged from the outlet side of the nip part.
Figure 7B:
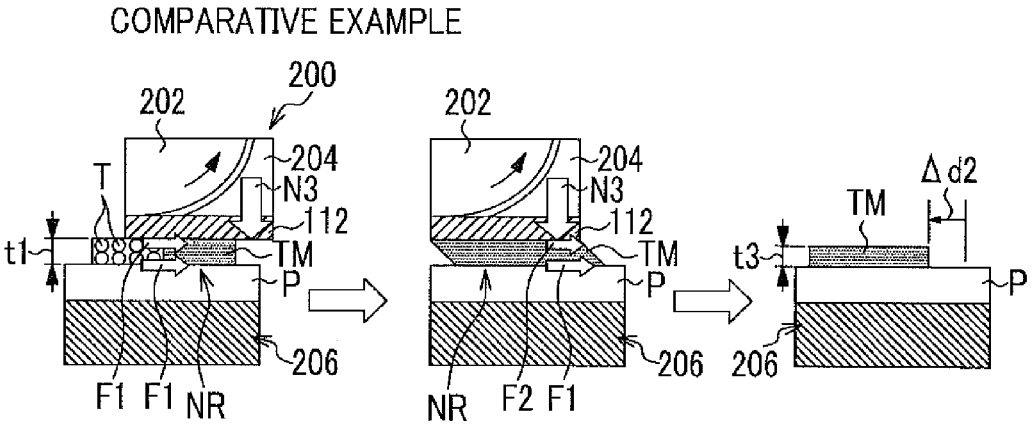
FIG. 7B is an explanatory view showing a state where recording paper enters the inlet side of a nip part related to a comparative example and is discharged from the outlet side of the nip part.

Next, fixing of the toner T in the fixing device 200 of the comparative example will be described with reference to the schematic view of FIG. 7B. In the fixing device 200 of the comparative example, the recording paper P and the toner T (shown by a circle) receives the driving force F1 and enters the fixing nip NR. In addition, the thickness of the toner T on the recording paper P is defined as t1. As the toner T receives heat and pressure, the toner melts and becomes toner TM (shown by meshing).

Subsequently, since the fixing belt 112 that moves through the fixing nip NR receives a frictional force μN3 (refer to FIG. 8) by the part (outlet side) of the peeling pad 204, the driving force F1 applied to a portion of the fixing belt 112 in the fixing nip NR decreases to a driving force F2. On the other hand, the recording paper P that moves through the fixing nip NA tends to move by the driving force F1 of the pressurizing roll 106. Thereby, the fixing belt 112 slips backward with respect to the recording paper P, and the toner TM slips (the toner TM receives a shear force).

As for the toner TM to fixed on the recording paper P in this way, the thickness becomes t3 (<t1), and the amount of deviation from an original position (position at transfer) becomes Δd2. That is, in the fixing device 200 of the comparative example, after fixing, the skin of the recording paper P is exposed and an image surface (the surface of the toner TM) becomes smooth. Thus, the contrast difference between the skin (part on which the toner TM is not deposited) of the paper, and the toner TM becomes large.

Operation

Next, the operation of the present exemplary embodiment will be described.

As shown in FIG. 6A, in the fixing device 100 of the present exemplary embodiment, the driving force F of the pressurizing roll 106 acts on the recording paper P in the fixing nip NF while fixing is performed to the recording paper P. Then, since a frictional force μN1 caused by the peak load N1 acts on the contact surface between the fixing belt 112 and the recording paper P on the inlet side of the fixing nip NF, a driving force FA that drives the recording paper P becomes F−μN1.

Subsequently, since a frictional force μN2 caused by the peak load N2 (<N1) acts on the contact surface between the fixing belt 112 and the recording paper P on the outlet side of the fixing nip NF, a driving force FB that drives the recording paper P becomes F−μN2, and becomes larger than the driving force FA on the inlet side. Thereby, the movement speed of the recording paper P is kept from decreasing on the outlet side rather than on the inlet side of the fixing nip NF. In addition, the shape of the pad 114B and the pressing state of the pressurizing roll 106 may be adjusted so as to result in peak load N1=N2 and driving force FA=FB.

Next, fixing of the toner T in the fixing device 100 of the present exemplary embodiment will be described with reference to the schematic view of FIG. 7A. In the fixing device 100, the recording paper P and the toner T (shown by a circle) receives the driving force F (refer to FIG. 6A) and enter the fixing nip NF. In addition, the thickness of the toner T on the recording paper P is defined as t1. As the toner T receives heat and pressure, the toner melts and becomes toner TM (shown by meshing).

Since the fixing belt 112 receives the frictional force μN1 caused by the peak load N1 on the inlet side of the fixing nip NF, the driving force becomes FA. In addition, since the overall toner T does not necessarily melt on the inlet side, there is almost no deviation of a toner image caused by the peak load N1. Since the fixing belt 112 receives the frictional force μN2 by the peak load N2 lower than the peak load N1 on the outlet side of the fixing nip NF, the driving force becomes larger FB than FA. Here, although the recording paper P that moves within the fixing nip NR tends to move due to the driving force F of the pressurizing roll 106, the driving force has the magnitude relationship of FA<FB<F and the difference between the driving force F and the driving force FB is small. Therefore, the toner TM that has melted on the outlet side of the fixing nip NF is kept from slipping backward (image deviation).

Since the image deviation is suppressed, the amount of deviation of the toner TM fixed on the recording paper P, from its original position (position at transfer) becomes Δd1 (almost 0 in practice). Additionally, since the load that acts on the toner TM is N2 on the outlet side of the fixing nip NF, and is lower than the load N3 (refer to FIG. 7B) of the comparative example, the thickness becomes t2 (greater than the thickness t3 (refer to FIG. 7B) of the comparative example, and smaller than the thickness t1).

That is, in the fixing device 100 of the present exemplary embodiment, the skin of the recording paper P is kept from being exposed after fixing and an image surface (the surface of the toner TM) is kept from becoming smooth more than needed. Therefore, the contrast difference between the skin (a part on which the toner TM is not deposited) of the paper, and the toner TM becomes small.

As described above, with the fixing device 100, in the fixing nip NF, the peak load N2 (peak pressure P2) on the outlet side is lower than the peak load N1 (peak pressure P1) on the inlet side, and the movement of the recording paper P is kept from being regulated on the outlet side. Thus, as compared to a configuration in which the peak pressure (load) on the outlet side is higher than the peak pressure (load) on the inlet side, the contrast difference between the ground of the recording paper P after the fixing of the toner T and the toner T are suppressed.

Additionally, with the fixing device 100, in the fixing nip NF, the integration value (load NB of FIG. 6B) of pressures on the outlet side is lower than the integration value (load NA of FIG. 6B) of pressures on the inlet side. Since the integration values of pressures are compared in this way, as compared to a configuration in which the integration values of pressures are not compared, comparison also including the difference between the areas on the inlet side and the outlet side become possible, and the difference between the pressure on the outlet side and the pressure on the inlet side in the fixing nip NF is obtained with high precision.

Moreover, in the fixing device 100, one pad member 114 on which the first convex portion 114D and the second convex portion 114E are formed is fixed (arranged) inside the fixing belt 112, pressure is imparted (pressurized) by the switching mechanism 140 to exert the peak loads N1 and N2. Thus, as compared to a configuration in which pressures are separately imparted to the inlet side and outlet side of the fixing nip NF, the difference between the frictional forces on the inlet side and the outlet side becomes small with a simple configuration.

On the other hand, in the image forming apparatus 10, the contrast difference between the ground of the recording paper P and the toner T is suppressed by the fixing of the toner T to the recording paper P by the fixing device 100. Thus, in the discharged recording paper P, the contrast difference between an image and the recording paper P is suppressed.

Additionally, in the image forming apparatus 10, the particle diameter of the toner T, the softening point of toner T, the smoothness of the recording paper P, and the pressures (loads) on the inlet side and the outlet side are specified in combination. Thus, the contrast difference between an image and the recording paper P is further suppressed.

In addition, the invention is not limited to the above exemplary embodiments.

The pressure imparting part may not only have a configuration in which the pressurizing roll 106 is brought close to the pad member 114 side, but a configuration in which the pad member 114 is pressed against the pressurizing roll 106 side. As an example of this configuration, a configuration may be adopted in which the load N is made to act on the side near the inlet of the fixing nip NF so that the load that acts on the outlet side becomes lower than the load that acts on the inlet side. Additionally, an elastic member (includes a spring) or a cam member to be driven may be used as a part for making load act.

The integration value of pressures is not limited to comparing the integration value from the position 0 to the position X1 and the integration value from the position X2 to the position X3. For example, with the middle position of the fixing nip NF as XA, the integration value from the position 0 to the position XA may be compared with the integration value from the position XA to the position X3.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing rotary body that heats toner while rotating and fixes the toner on a recording medium;

a pressurizing rotary body that sandwiches and pressurizes the toner and the recording medium by the fixing rotary body; and a supporting part that supports the fixing rotary body from the inside so that a peak pressure on an outlet side of the recording medium becomes less than or equal to a peak pressure on an inlet side, in a contact part where the fixing rotary body and the pressurizing rotary body come into contact with each other, wherein the supporting part supports the fixing rotary body from the inside so that an integration value of pressures on the outlet side of the recording medium becomes less than or equal to an integration value of pressures on the inlet side, in the contact part, wherein the toner has a particle diameter of 4.5 [μm] or less and a softening point of 100 [° C.] or higher and 140 [° C.] or lower, wherein the smoothness of the recording medium showing a surface state is 740 [sec] or more and 2000 [sec] or less, and wherein the peak pressure on the inlet side is 392 [kPa] or higher and 589 [kPa] or lower and the peak pressure on the outlet side is 294 [kPa] or higher and 392 [kPa] or lower.

2. The fixing device according to claim 1, wherein the supporting part is fixed so that the fixing rotary body slides on the supporting part.

3. A fixing device comprising:

a fixing rotary body that heats toner while rotating and fixes the toner on a recording medium;

a pressurizing rotary body that sandwiches and pressurizes the toner and the recording medium by the fixing rotary body; and a supporting part that supports the fixing rotary body from the inside so that a peak pressure on an outlet side of the recording medium becomes less than or equal to a peak pressure on an inlet side, in a contact part where the fixing rotary body and the pressurizing rotary body come into contact with each other, wherein the toner has a particle diameter of 4.5 [μm] or less and a softening point of 100 [° C.] or higher and 140 [° C.] or lower, wherein the smoothness of the recording medium showing a surface state is 740 [sec] or more and 2000 [sec] or less, and wherein the peak pressure on the inlet side is 392 [kPa] or higher and 589 [kPa] or lower and the peak pressure on the outlet side is 294 [kPa] or higher and 392 [kPa] or lower.

4. The fixing device according to claim 3, wherein the supporting part supports the fixing rotary body from the inside so that an integration value of pressures on the outlet side of the recording medium becomes less than or equal to an integration value of pressures on the inlet side, in the contact part.

5. The fixing device according to claim 4, wherein the supporting part is fixed so that the fixing rotary body slides on the supporting part.

6. An image forming apparatus comprising:

an image holding member holding a latent image;

an image forming section that develops the latent image of the image holding member with toner to form a toner image, and transfers the toner image to a recording medium to form an image; and a fixing device that fixes the toner image formed in the image forming section on a recording medium, the fixing device comprising:

a fixing rotary body that heats toner while rotating and fixes the toner on a recording medium;

a pressurizing rotary body that sandwiches and pressurizes the toner and the recording medium by the fixing rotary body; and a supporting part that supports the fixing rotary body from the inside so that a peak pressure on an outlet side of the recording medium becomes less than or equal to a peak pressure on an inlet side, in a contact part where the fixing rotary body and the pressurizing rotary body come into contact with each other, wherein the toner has a particle diameter of 4.5 [μm] or less and a softening point of 100 [° C.] or higher and 140 [° C.] or lower, wherein the smoothness of the recording medium showing a surface state is 740 [sec] or more and 2000 [sec] or less, and wherein the peak pressure on the inlet side is 392 [kPa] or higher and 589 [kPa] or lower and the peak pressure on the outlet side is 294 [kPa] or higher and 392 [kPa] or lower.

7. The fixing device according to claim 6, wherein the supporting part supports the fixing rotary body from the inside so that an integration value of pressures on the outlet side of the recording medium becomes less than or equal to an integration value of pressures on the inlet side, in the contact part.

8. The fixing device according to claim 7, wherein the supporting part is fixed so that the fixing rotary body slides on the supporting part.

* * * * *